United States Patent [19]

Danner

[11] Patent Number: 4,609,811

[45] Date of Patent: Sep. 2, 1986

[54] ELECTRIC HEAT EXCHANGER

[76] Inventor: Timothy J. Danner, R.D. #1, Box 153-C, Seven Valleys, Pa. 17360

[21] Appl. No.: 766,244

[22] Filed: Aug. 16, 1985

[51] Int. Cl.[4] ..... H05B 3/00

[52] U.S. Cl. ..... 219/302; 239/133; 261/78 A; 261/142; 431/208

[58] Field of Search ..... 219/275, 301, 302; 431/208, 209, 258; 239/133, 135; 261/78 A, 78 R, 142

[56] References Cited

U.S. PATENT DOCUMENTS

| | | | |
|---|---|---|---|
| 2,841,215 | 7/1958 | Messer | 239/135 X |
| 3,034,726 | 5/1962 | Peras | 239/133 X |
| 3,090,420 | 5/1963 | Sacco | 219/301 X |
| 3,876,363 | 4/1975 | LaHaye et al. | 239/135 X |
| 4,255,121 | 3/1981 | Sugimoto | 239/135 X |
| 4,472,133 | 9/1984 | Peterson et al. | 431/208 X |
| 4,472,134 | 9/1984 | Ettman | 431/208 X |
| 4,480,172 | 10/1984 | Ciciliot et al. | 219/302 X |
| 4,572,943 | 2/1986 | Hogfeldt | 219/302 X |

*Primary Examiner*—John Sipos
*Assistant Examiner*—Steven P. Weihrouch
*Attorney, Agent, or Firm*—Daniel J. O'Connor

[57] ABSTRACT

An electric heat exchanger and adaptor bushing designed to provide for the complete vaporization of a heating fuel.

A first easily machined element has electric resistance heaters contained entirely within a solid portion thereof comprising a first zone. Second and third zones of the first machined element provide for mixing and attachment respectively.

By use of a second machined element, the invention device may be effectively used to retrofit an existing system to thereby greatly enhance system efficiency.

10 Claims, 3 Drawing Figures

ELECTRIC HEAT EXCHANGER

BACKGROUND OF THE INVENTION

This invention relates generally to an electric heater or electric heat exchanger for the vaporization of fluids.

The most relevant prior art known to applicant herein is that shown in U.S. Pat. No. 4,480,172 issued to Ciciliot et al.

Home heating fuels have risen to and remained at relatively high prices over the last decade. Accordingly, many in the art have realized the need to provide a more efficient energy output from such widely used fuels as No. 1 and No. 2 grade home heating oils.

Various systems to preheat home heating fuel oils have been developed in the art. It has been known, for example, to preheat a specified volume of liquid fuel oil before it is atomized in a spray nozzle and subsequently ignited. Such systems have improved fuel efficiency to a certain extent but, typically, have required a large heat energy input for a relatively low increase in efficiency.

It has also been known in the prior art to utilize spiral coil electric heating elements in various modes to heat or preheat fuel oil to improve efficiency.

One system which has been developed in the art has been the bypass atomization nozzle. In place of the conventional fuel line and atomization nozzle, a portion of the liquid fuel which is not atomized is returned via a bypass line to the fuel supply tank and again pumped into the fuel line. Such bypass systems have resulted in a more efficient oil burn and hence a higher energy output.

Most of the efficiency improving systems of the past decade have required an entirely new system. Thus, the homeowner has been faced with the dilemma of either buying an entirely new furnace at a high cost or of keeping his old furnace and continuing to pay high monthly or quarterly fuel bills. For example, the known pulse combustion heaters have been effective in improving fuel efficiency but have required the purchase of an entirely new system by the homeowner.

Prior art fuel energy efficiency improving systems have proven very costly to machine and manufacture. They have not recognized the need of a homeowner to purchase a system by which he can simply and economically modify his existing heating system to achieve a more efficient heat energy production.

Of course, efforts have also been made to improve fuel efficiency for larger industrial installations with most encountering the same problems as outlined above.

OBJECTS OF THE INVENTION

Accordingly, it is an object of the present invention to provide an electric heater or electric heat exchanger which may be simply and economically mass produced.

It is a further object of the present invention to provide an electrically heated fuel vaporizer designed to be retrofit onto existing heating systems thereby saving the homeowner the cost of an entirely new heating system to achieve fuel efficiency.

It is a still further object of the present invention to provide an electrically heated fuel vaporizer which may be easily installed on an existing furnace nozzle system by the homeowner or by maintenance/installation personnel.

It is also an object of the present invention to provide an electrically heated fuel vaporizer which effectively raises the temperature of atomized fuel to a range of approximately 1100° F. for complete vaporization and combustion and consequent reduction of carbon and tar buildup in the overall furnace system.

It is a further object to provide an electrically heated fuel vaporizer of the add-on or retrofit type which has an outer shape, a mixing orifice sizing, a mixing chamber shape, and an air inlet orifice location which result in maximized burning efficiency for home heating oils.

It is a further object of the invention to provide an electrically heated fuel vaporizer adapted to be utilized with an existing bypass atomization nozzle system to improve the efficiency thereof.

Further objects and advantages of the present invention will become apparent as the following description proceeds, and the features of novelty characterizing the invention will be pointed out with particularity in the claims annexed to and forming a part of this specification.

BRIEF SUMMARY OF THE INVENTION

The invention, in its subcombination form, consists of two machined pieces adapted to be added on to an existing bypass atomization nozzle system.

The first machined piece is essentially cylindrical in overall shape and has three sections or zones formed as a part thereof. A first section or zone forms the outer cylinder in which are tapped, for the entire length of the cylinder, holes for the insertion of lengthwise electrical resistance heaters. Also tapped into said first zone are apertures for combustion air inlet and for a temperature probe.

A second section or zone of the first machined piece forms an internal mixing chamber in which complete vaporization of the fuel oil is accomplished. The mixing chamber is machined to a smooth surface to reduce fuel and air drag and further includes an angled exit portion and an exit orifice sized so as to prevent backpressure in the device.

A third section or zone of the first machined piece comprises a reduced exterior diameter portion to allow for insertion of the aforementioned electric resistance heaters and also has internal threads to allow for engagement of a nozzle adaptor bushing.

The second machined piece of the invention comprises a nozzle adaptor bushing. Such bushing is sized in its internal diameter so as to slide over one end of a bypass nozzle adaptor. The bushing also has external threads on one end thereof designed to engage the threads of the third zone of the first machined piece described above.

The invention structure allows easy modification of an existing nozzle system and results in greatly improved efficiency of such a system.

DETAILED DESCRIPTION OF THE INVENTION

Figure 1:
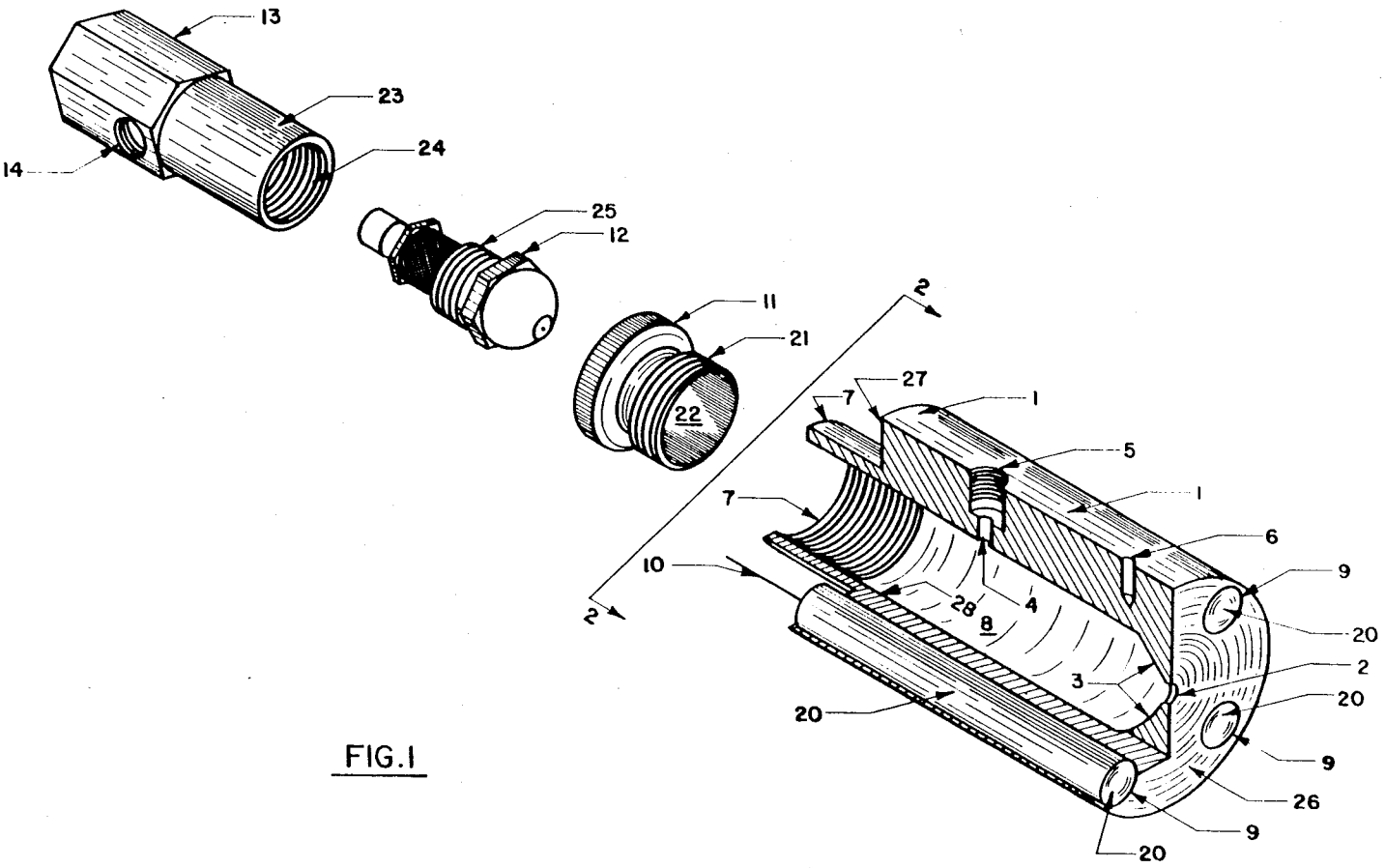
FIG. 1 shows an isometric exploded view of two machined pieces of the invention in their operational relation to the conventional bypass nozzle and bypass nozzle adaptor elements. The first machined piece is shown partly in section.

Referring now to the drawings in detail, in which the same numerals have been used for like component parts, there is shown in the exploded view of FIG. 1 a conventional bypass nozzle 12 and bypass nozzle adaptor 13.

Figure 3:
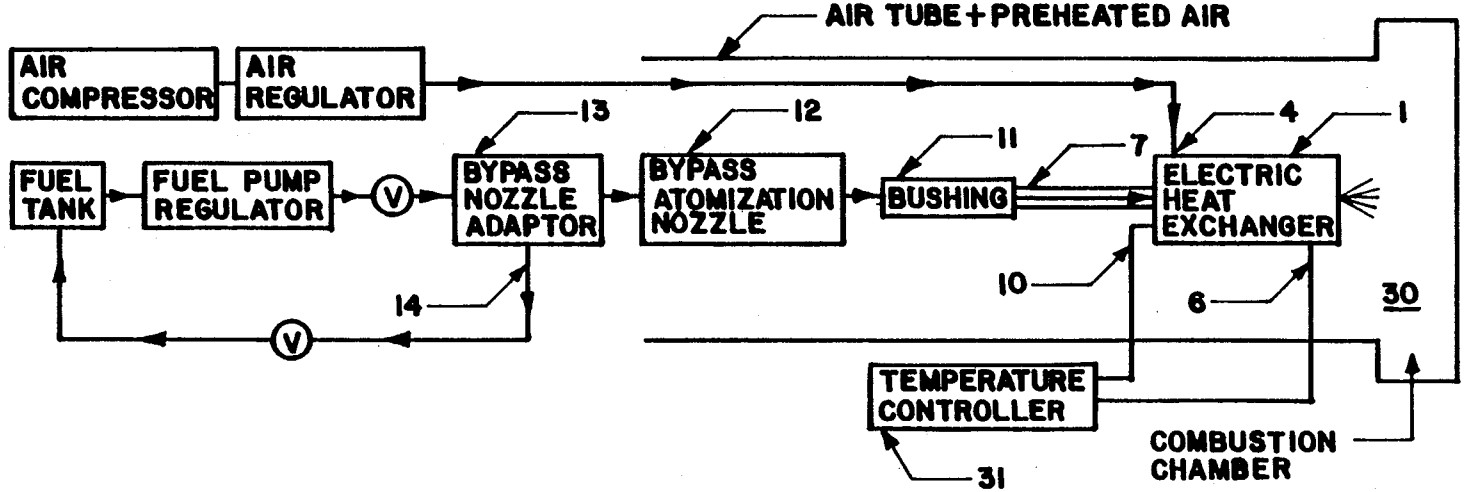
FIG. 3 shows a block diagram system view illustrating a conventional bypass nozzle system and the attachment of the invention to said system.

In order to understand what is known in the art as a bypass nozzle system, reference is made briefly to FIG. 3. As shown in said figure, liquid fuel which is not atomized is returned via line 14 through appropriate valving to a fuel tank where it is reintroduced into the fuel supply line. The bypass atomization nozzle 12 and the bypass nozzle adaptor 13 are indicated in block diagram form in FIG. 3 to illustrate the overall system with which the present invention has been most successfully tested. It should be noted, however, that the broad concepts of the present invention could be successfully utilized with a conventional atomization nozzle system. Shown to the right of FIG. 3 in block diagram form are portions of the invention subcombination to be described.

As shown to the right of FIG. 3, this invention involves the addition of first and second machined elements, 1 and 11 respectively, to a conventional bypass nozzle system. The addition of these two machined elements to the bypass nozzle system provides for complete vaporization of fuel supplied to a combustion chamber and, therefore, enhanced burning and heating efficiency.

The system diagram of FIG. 3 also shows air supply to the electric heat exchanger 1 at orifice 4 and temperature control via probe 6 through a known controller 31 to electric resistance heater leads 10, said elements to be more fully described.

Also shown in the system FIG. 3 is an outer air tube to provide a preheated natural draft to the combustion chamber 30.

As indicated in FIG. 3, the electric heat exchanger 1 has an extended zone 7 adapted to mate with bushing 11 whereby the two main pieces of the present invention may be retrofit easily into the bypass nozzle system.

Referring again to FIG. 1, it is to be understood that nozzle 12 has external threads 25 thereon for sealing engagement with internal threads 24 of end 23 of the bypass nozzle adaptor 13. Aperture 14 feeds fuel to the return line as previously described with reference to FIG. 3.

Figure 2:
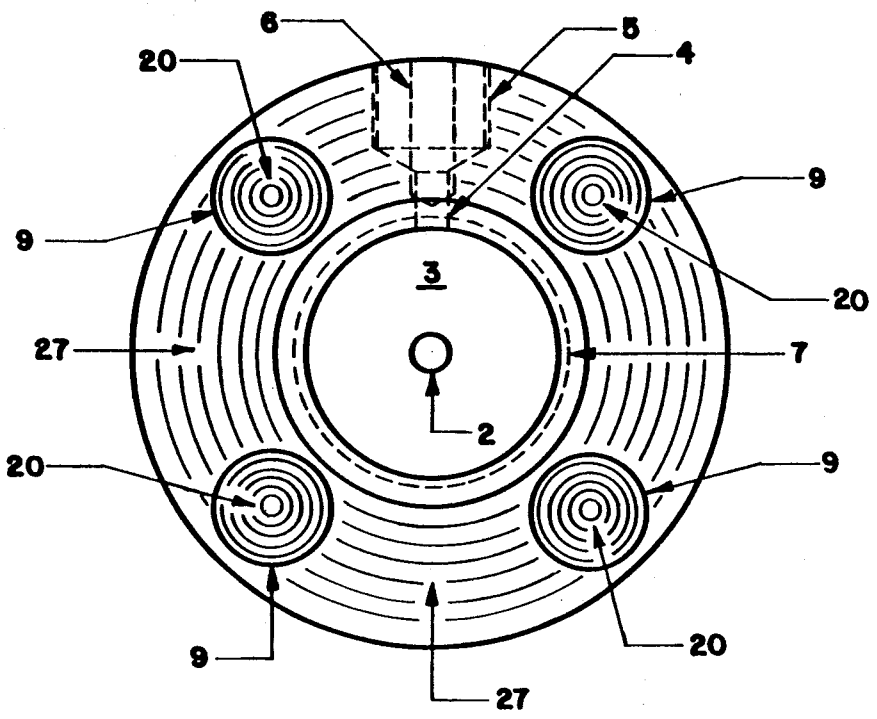
FIG. 2 shows an end view along lines 2—2 of FIG. 1 of the first machined piece of the invention.

In accordance with the present invention and referring now to FIGS. 1 and 2, two machined pieces are designed to be operationally attached to the existing nozzle 12 and adaptor 13 combination.

A first machined element indicated at numeral 1 comprises an electrically heated cylinder having essentially three sections or zones as an integral part thereof.

A first section or zone of the first machined element of the invention comprises the solid body portion of the electric heater indicated at 1. The solid body portion is made of high-grade steel and has bores 9 machined lengthwise therethrough for the receipt of electrical resistance heater elements 20 having leads 10 attached thereto.

As shown, in practice of the invention, it is contemplated that the machined bores 9 extend entirely through the length of the first section or zone for reasons to be described more fully hereinbelow.

The cylindrical first section or zone 1 has flattened end portions 26 and 27.

Zone 1 also has machined therein, perpendicular to its cylindrical axis, an air inlet orifice 4 and a communicating threaded air inlet fitting 5 for the supply of combustion air to the interior of zone 1. It has been found advantageous in testing of the device that orifice 4 be positioned so as to lie between 25–50% of the distance between flattened ends 27 and 26 for reasons to be more fully explained.

Zone 1 also has machined therein a sensor chamber bore 6. In operation of the invention apparatus, a temperature sensor is placed in bore 6 and, if the solid body of zone 1 falls below a predetermined temperature of, for example, 1100° F., resistance heaters 20 are activated by a conventional controller 31 through leads 10.

The first machined element of the invention also includes a second zone shown essentially as a mixing chamber at numeral 8. This second zone is formed by a precision stock machining drill so that walls 28 of the mixing chamber 8 are smooth to reduce fuel and air flow drag.

By using a stock drill to form the second zone or mixing chamber 8, angled end portions of the mixing chamber are formed at 3. In testing of the invention, it has been found that at least one optimal total exit angle formed at numeral 3 would be approximately 118 degrees.

Also machined as a part of the second zone of the device is a mixing chamber exit orifice 2. In practice of the invention, exit orifice 2 must be sized large enough so that, upon furnace shutdown, residual vaporized fuel does not exit from orifice 2 in any substantial amounts.

The first machined element of the invention also has formed as a part thereof a third section or zone means indicated generally at numeral 7. This third section or zone means has a reduced exterior diameter portion so that leads 10 and electric heating elements 20 may be appropriately fitted into the solid body portion end 27 of the first zone.

The third section or zone 7 is internally an extension of the interior diameter of mixing chamber 8 and third zone 7 has internal threads formed thereon, as shown, for appropriate engagement with a mounting bushing to be described.

The invention in its subcombination form also includes a second element comprising a bushing shown at numeral 11. Bushing 11, which may be fabricated of brass, has exterior threads 21 formed thereon sized to mate with the internal threads of the third zone 7 of the first machined element described above. Bushing 11 also has a smooth internal diameter 22 sized so as to fit over the exterior diameter 23 of the bypass nozzle adaptor 13. Bushing 11 would then be appropriately attached to the bypass nozzle adaptor 13 so that it lies flush with the righthand side of said nozzle adaptor 13.

From the exploded isometric view of FIG. 1, it can be see that the two machined elements 1 and 11 of the invention can be easily adapted to an existing conventional bypass nozzle 12 without any extensive modifications of an existing furnace system.

Applicant's extensive testing of the invention structure has revealed a number of critical and optimal features presented by the machined elements 1 and 11.

Regards the first machined element comprising first, second and third zones 1, 8 and 7, respectively, the following features have been found to be of importance. The bores 9 should be formed so that resistance heaters 20 can extend entirely the length of and yet be internal to the first zone. Such results in a more uniform heating of the first machined element and consequent improved burning efficiency of the fuel-air mixture in the second zone 8.

It has also been found that end 26 of zone 1 should be of the flattened shape shown so as to provide for an increased heating area in the region of exit angle 3. That is, if end 26 were tapered to conform to the exit angle 3, then less heated volume of the first zone would be available for the critical heating of fuel and air at exit orifice 2.

It has further been found that the location of air inlet orifice 4 is of importance to the invention. The air inlet orifice is located so that, in operation of the device, the atomized fuel spray from nozzle 12 strikes the interior wall 28 just to the right of, i.e. just downstream of, the air inlet orifice 4. In this manner, mixing is more effectively accomplished and the entire mixture is more effectively driven into the mixing chamber 8 and toward the mixing chamber exit orifice 2.

It has also been found that the formation of the third zone 7 as essentially an extension of the internal diameter of the first zone 1 is of importance in the complete sealing of the invention structure when added or retrofit onto an existing bypass nozzle 12. That is, any leakage problems which might be encountered with a flanged seal design are avoided and the invention provides an essentially leak-proof design.

Applicant has also realized the importance of a structure which may be easily mass-produced utilizing conventional machine shop tooling. For example, bores 4, 6 and 9 may be conveniently made in the first machined element. The mixing chamber 8 and its smooth flow-enhancing walls 28 and exit angle 3 are formed by simply drilling the first machined element with a stock drill, as is exit orifice 2.

The inventor's extensive testing and design of the described device has resulted in a system which may be economically manufactured, easily installed in add-on or retrofit fashion to an existing furnace and which produces superior fuel burning efficiencies when compared to other systems known in the art.

The highly desirable goals of achieving optimal heating efficiencies and reduced tar and carbon desposits in the furnace are accomplished by the overall structure of the present design.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. An electric heat exchanger for vaporizing a fluid which is introduced into said heat exchanger by means of a by-pass nozzle system comprising:

a first machined element having formed as a part thereof a first zone (1), a second zone (8), and a third zone (7), said first zone (1) comprising an elongated cylindrical metal element having a plurality of bores (9) formed in substantially the entire length of said first zone, electric heating elements within said plurality of bores for heating said second zone;

air inlet orifice means (4) formed substantially perpendicular to the axis of said first zone cylindrical element and extending through said first zone to said second zone, fluid inlet means for the introduction of fluid into said second zone;

said second zone (8) within said first zone and comprising an air and fluid mixing chamber having smooth walls (28), said mixing chamber being devoid of any internal heating elements, said second zone including an angled exit portion (3) at a downstream location thereof and further including an exit orifice (2) downstream of said angled exit portion (3), said third zone (7) comprising a reduced exterior diameter portion and an internal diameter portion which is an extension of the smooth wall diameter (28) of said second zone and upstream of said air and fluid mixing chamber, the internal diameter of said third zone (7) including attachment means for affixing said first machined element to a by-pass nozzle adaptor (13) of a by-pass nozzle (12) system.

2. The apparatus of claim 1 wherein the attachment means of said third zone (7) comprises internal thread means.

3. The apparatus of claim 2 including a second machined element (11) having external thread means (21) thereon for attachment to the internal thread means of said third zone (7) of said first machined element, and wherein said second machined element (11) includes a smooth internal diameter means (22) for sliding engagement with an end portion (23) of a by-pass nozzle adaptor (13).

4. The apparatus of claim 1 wherein said plurality of bores (9) are internal of said first zone (1) of said first machined element, and wherein elongated resistance heating elements (20) are contained within said bores (9) so as to be contained entirely within said first zone.

5. The apparatus of claim 1 wherein the total angle of said angled exit portion (3) is approximately 118 degrees.

6. The apparatus of claim 1 wherein said first zone includes a first flattened end portion (27) and a second flattened end portion (26).

7. The apparatus of claim 6 wherein said air inlet orifice means (4) is positioned within said first zone at a distance of from 25 to 50 percent of the distance between said first flattened end (27) and said second flattened end portion (26).

8. The apparatus of claim 1 including sensor bore means (6) formed at least partly through said first zone.

9. The apparatus of claim 3 wherein said first and second machined elements (1, 11) are positioned in a system downstream of a bypass nozzle (12) and a bypass nozzle adaptor, said bypass nozzle (12) and bypass nozzle adaptor being part of a fuel recirculating system.

10. The apparatus of claim 8 including a temperature controller (31) means in response to a temperature probe which may be positioned in sensor bore (6), said temperature controller (31) means serving to activate electrical resistance heaters (20) via lead lines (10), said electrical resistance heaters (20) being contained entirely within said first zone (1) of said first machined element.

* * * * *